US005079809A

United States Patent [19]

Teich et al.

[11] Patent Number: 5,079,809

[45] Date of Patent: Jan. 14, 1992

[54] ANTI-BINDING ZIPPER SLIDER

[76] Inventors: Garland N. Teich, 15020 Old Seward, Anchorage, Ak. 99516; George Spector, 233 Broadway, Rm. 3815, New York, N.Y. 10007

[21] Appl. No.: 584,516

[22] Filed: Sep. 14, 1990

[51] Int. Cl.[5] ..... A44B 19/26

[52] U.S. Cl. ..... 24/426

[58] Field of Search ..... 24/426, 427, 429

[56] References Cited

U.S. PATENT DOCUMENTS 2,095,270 10/1937 Silberman ..... 24/426
2,810,174 10/1957 Mikulas ..... 24/426
2,824,352 2/1958 Foltis ..... 24/426
3,604,070 9/1971 Vorsteher ..... 24/426
3,973,300 8/1976 Takamatsu et al. ..... 24/426
4,142,275 3/1979 Krauer ..... 24/426
4,590,648 5/1986 Yoshida et al. ..... 24/426 X

*Primary Examiner*—James R. Brittain

[57] ABSTRACT

An anti-binding slide for a slide fastener is provided and consists of a side wing segment at each corner of the slide to make a spreading action for reducing the binding of material to be zipped together and separated. The retainer bar is elongated and has an elongated slot therein so that the pull tab will put pressure at either extreme end of the slide when pulling the slide.

1 Claim, 1 Drawing Sheet

ANTI-BINDING ZIPPER SLIDER

BACKGROUND OF THE INVENTION

The instant invention relates generally to slide fasteners and more specifically it relates to an anti-binding slide for a slide fastener which provides a spreading action to reduce the binding of material to be zipped together.

There are available various conventional slider's at present which do not provide the novel improvements of the invention herein disclosed.

SUMMARY OF THE INVENTION

A primary object of the present invention is to provide an anti-binding slide for a slide fastener that will overcome the shortcomings of the prior art devices.

Another object is to provide an anti-binding slide for a slide fastener that has side wing segments to make a spreading action to reduce the binding of material to be zipped together and separated.

An additional object is to provide an anti-binding slide for a slide fastener having extended wing segments to deflect the edges of a garment when the slide fastener is in operation.

A further object is to provide an anti-binding slide for a slide fastener that is simple and easy to use.

A still further object is to provide an anti-binding slide for a slide fastener that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
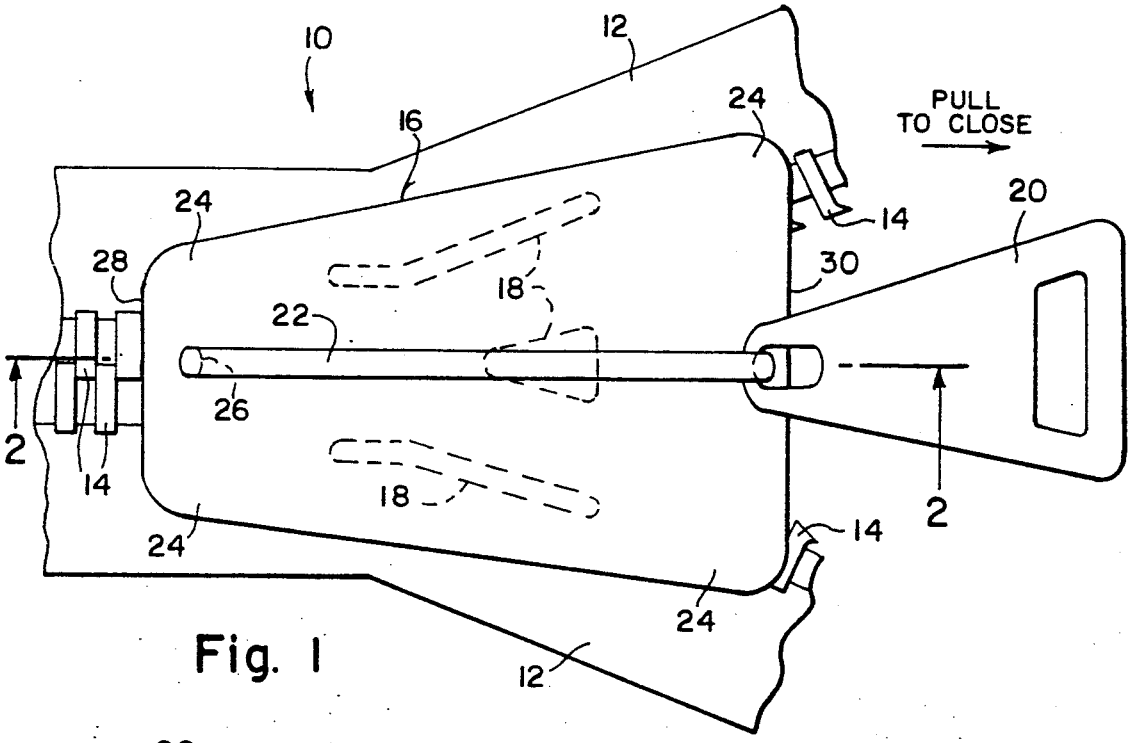
FIG. 1 is a top view of the invention as part of a slide fastener.
Figure 2:
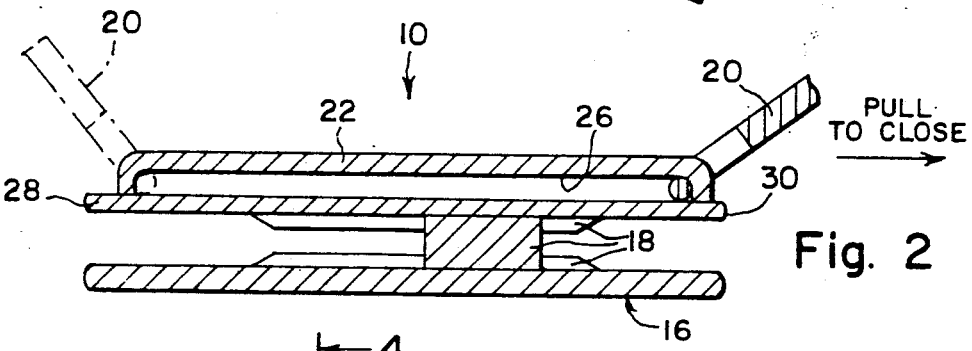
FIG. 2 is a cross sectional view taken along line 2—2 in FIG. 1.

Turning now descriptively to the drawings, in which similar reference characters denote similar elements throughout the several views, FIGS. 1 and 2 illustrate a slide fastener 10 of the type having two tapes 12 with interconnecting teeth 14 thereon, a slide 16 with a divider 18 to separate the teeth 14 and a pull tab 20 attached to a retainer bar 22 on the slide 16. The invention consists of a side wing segment 24 at each corner of the slide 16 to make a spreading action for reducing the binding of material to be zipped together and separated. The retainer bar 22 is elongated and has an elongated slot 26 therein so that the pull tab 20 will put pressure at either extreme end 28 and 30 of the slide 16 when pulling the slide.

Figure 3:
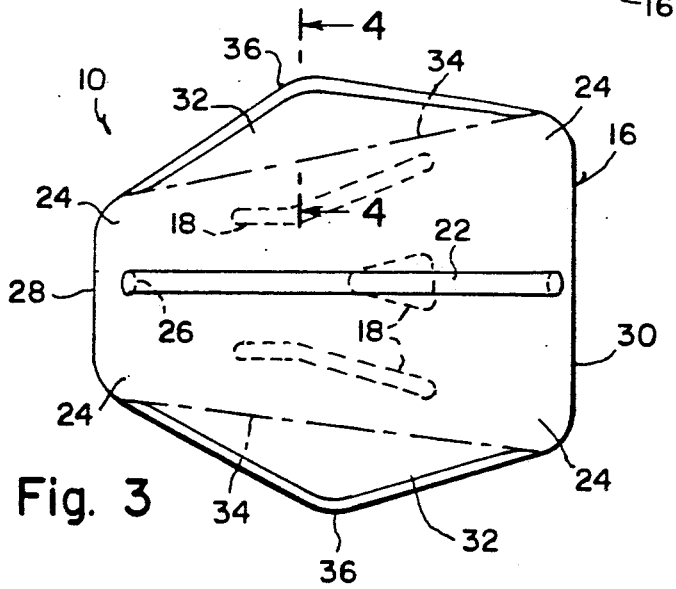
FIG. 3 is a top view of a modification in which extended wing segments on the slide are provided to deflect the edges of the garment when in operation.
Figure 4:
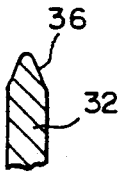
FIG. 4 is a cross sectional view taken along line 4—4 in FIG. 3 showing one of the extended wing segments tapered along its edge.

As shown in FIG. 3, an extended wing segment 32 at each side 34 of the slide 16 will deflect the edges of a garment when the slide 16 of the slide fastener 10 is in operation. Each extended wing segment 32 has tapered edges 36 to increase the deflection of the garment when the slide 16 of the slide fastener 10 is in operation. The wings 24 of the slide 16 can be pinched closer together when used for thinner materials being zipped together, such as a light nylon as used in a sleeping bag.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a slide fastener of the type having two tapes with interconnecting teeth thereon, a slide having a front and rear with a divider attached thereto to separate the teeth in combination with a pull tab attached to a retainer bar mounted on the slide, further comprising spaced side wing segments which diverge from said front providing a spreading action preventing binding of material to be zipped together and separated; further comprising said retainer bar being elongated and having an elongated slot therein so that the pull tab can be moved along said slot to put pressure at either extreme end of the slide pulled; further comprising an extended wing segment over-lapping each side of the slide to deflect the edges of a garment when the slide of the slide fastener is in operation; further comprising each said extended wing segment having tapered edges to increase the deflection of the garment when the slide of the slide fastener is in operation and wherein said extended wing segments include a front portion diverging from said slide and a rear portion tapering towards and connecting with said slide rear whereby material is spread away from the zipper teeth when the slide is moved in either direction, wherein said divider comprises a wedge underlying said slide between a pair of spaced guides for the zipper teeth, said wedge and guides being centered along the zipper teeth within the longitudinal extent of said retainer bar.

* * * * *